US010153102B2

(12) United States Patent
Freeman

(10) Patent No.: US 10,153,102 B2
(45) Date of Patent: Dec. 11, 2018

(54) LOCKOUT, TAGOUT DEVICE FOR SLIDELINK ENERGY ISOLATION ARRANGEMENT

(71) Applicant: Duke Energy Corporation, Charlotte, NC (US)

(72) Inventor: Richard T. Freeman, Marshville, NC (US)

(73) Assignee: Duke Energy Corporation, Charlotte, NC (US)

( * ) Notice: Subject to any disclaimer, the term of this patent is extended or adjusted under 35 U.S.C. 154(b) by 0 days.

(21) Appl. No.: 15/227,584

(22) Filed: Aug. 3, 2016

(65) Prior Publication Data

US 2018/0040435 A1 Feb. 8, 2018

(51) Int. Cl.

| | |
|---|---|
| ***H01H 9/28*** | (2006.01) |
| ***H01H 9/22*** | (2006.01) |
| *H01H 71/56* | (2006.01) |

(52) U.S. Cl.

CPC ..... *H01H 9/22* (2013.01); *H01H 9/282* (2013.01); *H01H 9/283* (2013.01); *H01H 2071/565* (2013.01)

(58) Field of Classification Search

CPC .. H01H 9/282; H01H 9/283; H01H 2071/565; H01H 9/281; H01H 71/56; H01H 9/223; H01H 9/28; H01H 31/06; H01H 9/286; H01H 9/26

USPC ..... 200/43.11, 43.15, 43.19, 43.16, 43.22, 200/334

See application file for complete search history.

(56) References Cited

U.S. PATENT DOCUMENTS

| | | | | |
|---|---|---|---|---|
| 4,669,794 | A | 6/1987 | Benda | |
| 5,338,228 | A | 8/1994 | Wright, Jr. et al. | |
| 5,432,309 | A * | 7/1995 | Takeuchi | F16P 3/10 200/334 |
| 5,556,305 | A | 9/1996 | Naegelin | |
| 5,797,298 | A | 8/1998 | Grevel | |
| 5,982,266 | A | 11/1999 | Sanford et al. | |
| 6,580,041 | B1 | 6/2003 | Ransopher | |
| 7,355,132 | B1 | 4/2008 | Rezac et al. | |
| 9,059,533 | B2 | 6/2015 | Bogart et al. | |

(Continued)

*Primary Examiner* — Ahmed Saeed

(74) *Attorney, Agent, or Firm* — Womble Bond Dickinson (US) LLP

(57) ABSTRACT

A lockout, tagout (LOTO) device and associated implementation method for a switchable energy isolation device are provided. The isolation device includes first and second electrical terminal members and a slideable linkage disposed and in electrical communication therebetween for switching the electrical terminal members between isolated and non-isolated states. The LOTO device includes a cover member configured to extend over the terminal members and the linkage, and a fastener member coupled to the cover member. The fastener member is configured to engage the first or second electrical terminal member to secure the cover member to the isolation device. A tagging member is configured to engage the fastener member and a securing member engaged with the cover member, upon the cover member being secured to the isolation device, to prevent the fastener member from disengaging the first or second electrical terminal member without the tagging member disengaging the fastener member.

14 Claims, 8 Drawing Sheets

(56) References Cited

U.S. PATENT DOCUMENTS

| | | | | |
|---|---|---|---|---|
| 2002/0092748 | A1* | 7/2002 | Su | H01H 23/145 200/339 |
| 2012/0047973 | A1* | 3/2012 | Su | G05G 5/02 70/174 |
| 2015/0099379 | A1* | 4/2015 | Borden | H01R 13/44 439/133 |
| 2015/0221459 | A1* | 8/2015 | Oneufer | H01H 9/281 200/50.26 |
| 2015/0315822 | A1* | 11/2015 | Garthe | E05B 67/003 70/15 |
| 2017/0110218 | A1* | 4/2017 | Wakabayashi | H01B 7/0045 |

* cited by examiner

LOCKOUT, TAGOUT DEVICE FOR SLIDELINK ENERGY ISOLATION ARRANGEMENT

BACKGROUND OF THE DISCLOSURE

Field of the Disclosure

The present disclosure relates to a lockout, tagout device and, in particular, lockout, tagout devices for a switchable energy isolation arrangement such as, for example, a slidelink device. The lockout, tagout devices of the present disclosure are configured to prevent an operator from inadvertently energizing an electrical circuit in electrical communication with such a switchable energy isolation device.

Disclosure of Related Art

When interacting with and performing maintenance on highly energized electrical circuits, it is imperative to provide a safe environment. In particular, a switchable energy isolation device such as, for example, a slidelink device, is usually switched to an isolated state (i.e., a non-energized state) before a user performs maintenance and/or other operations on the electrical circuit having the switchable energy isolation arrangement. Previous solutions have provided various arrangements for tagging the energy isolation device to indicate the electrical circuit is in a non-energized state. However, these tagging devices may still provide physical access to the slidelink of the energy isolation device, thus allowing for unintended re-energizing of the electrical circuit while the circuit is supposed to be locked out and tagged out. Additionally, other known lockout, tagout devices may include portions configured to block the movement of the slidelink of an energy isolation device to prevent the slidelink from being moved to return the energy isolation device to a non-isolated state. However, such lockout, tagout devices may still be inadvertently disengaged from the energy isolation device by merely removing or displacing the lockout, tagout device from the energy isolation device. For example, a portion of a lockout, tagout device configured to block the movement of the slidelink of the energy isolation device may be disengaged from the energy isolation device thereby allowing the slidelink to be moved and return the energy isolation device to a non-isolated state while the circuit is supposed to be locked out and tagged out. Thus, there exists a need for a method and apparatus directed to maintaining an energy isolation device in an isolated state during a lockout, tagout procedure.

BRIEF SUMMARY OF THE DISCLOSURE

The above and other needs are met by aspects of the present disclosure which, in one aspect, provides a lockout, tagout device useful in preventing the undesired re-energizing of an electrical circuit in electrical communication with a switchable energy isolation device. In particular, the present disclosure relates to lockout, tagout devices that require positive and deliberate interaction with the lockout, tagout device before the lockout, tagout device can be disengaged from the energy isolation device and before a slideable linkage can even be accessed to switch the energy isolation device between an isolated state and a non-isolated state.

In various aspects, the present disclosure provides a lockout, tagout (LOTO) device for a switchable energy isolation device. The energy isolation device includes a first and second electrical terminal members and a slideable linkage disposed and in electrical communication therebetween, with the slidelink being configured to switch the first and second electrical terminal members between an isolated state (i.e., non-energized) and a non-isolated state (i.e., energized) with respect to the electrical circuit.

The lockout, tagout device includes a cover member configured to engage the isolation device so as to extend over the first and second electrical terminal members and the slideable linkage therebetween. Additionally, the lockout, tagout device includes a fastener member coupled to the cover member, wherein the fastener member is configured to engage the first or second electrical terminal member so as to secure the cover member to the isolation device. Further, the lockout, tagout device includes a securing member engaged with the cover member. In some aspects, the lockout, tagout device includes a tagging member configured to engage the fastener member and the securing member, upon the cover member being secured to the isolation device, to prevent the disengagement of the fastener member from the first or second electrical terminal member without disengagement of the tagging member from the fastener member.

In some aspects, a method of engaging a lockout, tagout device with a switchable energy isolation device is also provided. The switchable energy isolation device includes a first and second electrical terminal members and a slideable linkage disposed and in electrical communication therebetween for switching the isolation device between an isolated (i.e., non-energized) and non-isolated state (i.e., energized) with respect to the electrical circuit.

According to some aspects, the method includes engaging a cover member with the isolation device such that the cover member extends over the first and second electrical terminal members and the slideable linkage therebetween. The method further includes engaging a fastener member, coupled to the cover member, with the first or second electrical terminal member to secure the cover member to the isolation device. Additionally, the method includes engaging a tagging member with the fastener member and a securing device engaged with the cover member, upon the cover member being secured to the isolation device, to prevent disengagement of the fastener member from the first or second electrical terminal member without disengagement of the tagging member from the fastener member. Further features and advantages of the present disclosure are set forth in more detail in the following description.

BRIEF DESCRIPTION OF THE DRAWINGS

Figure 1:
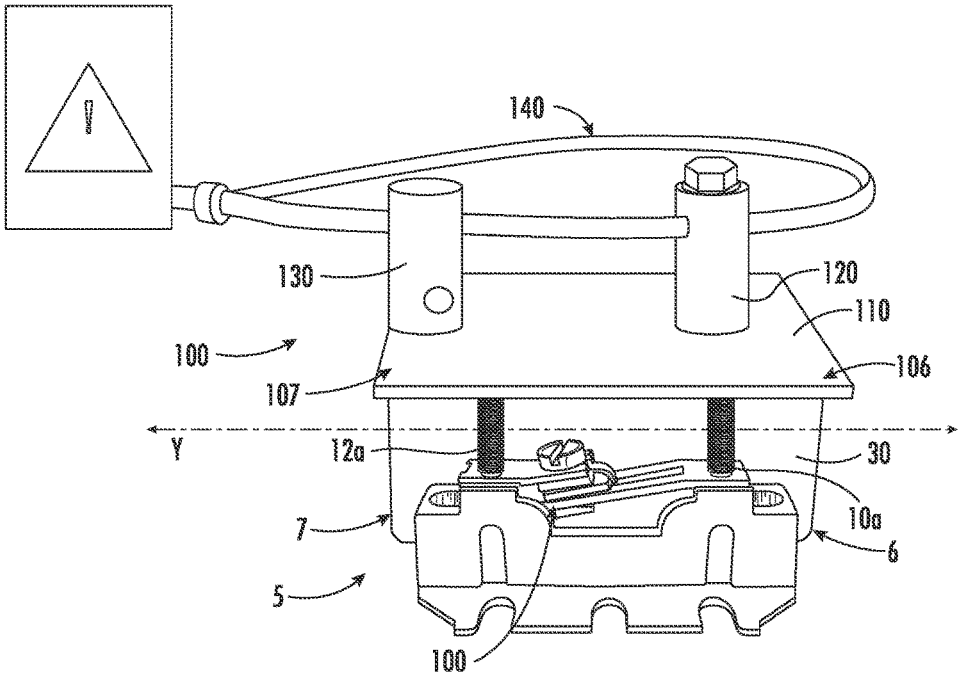
Figure 2A:
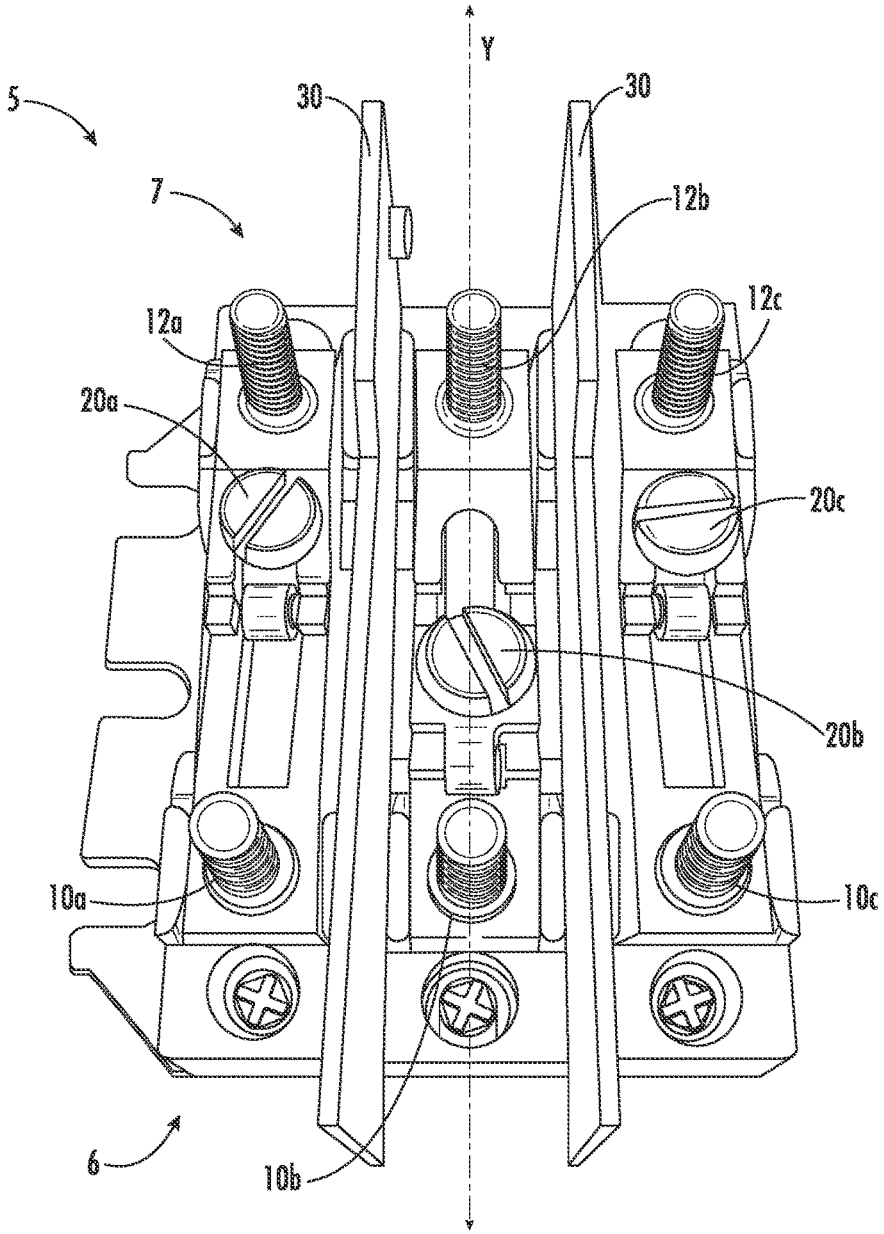
Figure 2B:
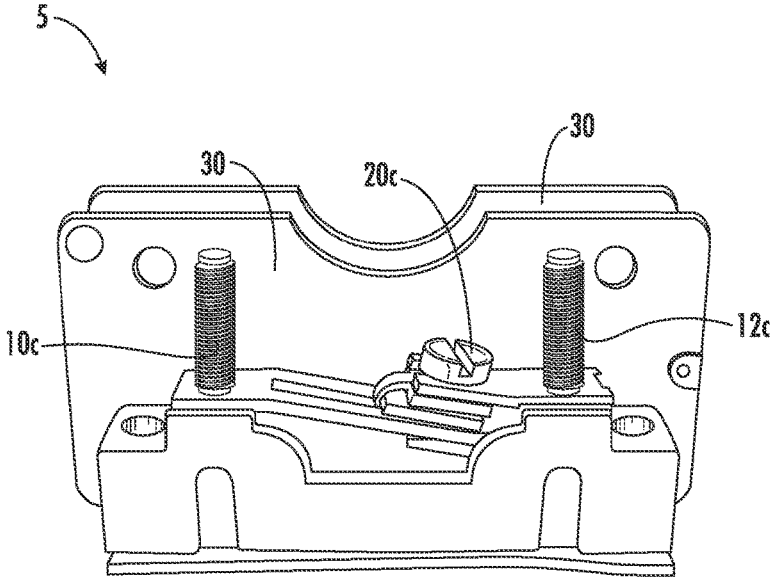
Figure 3A:
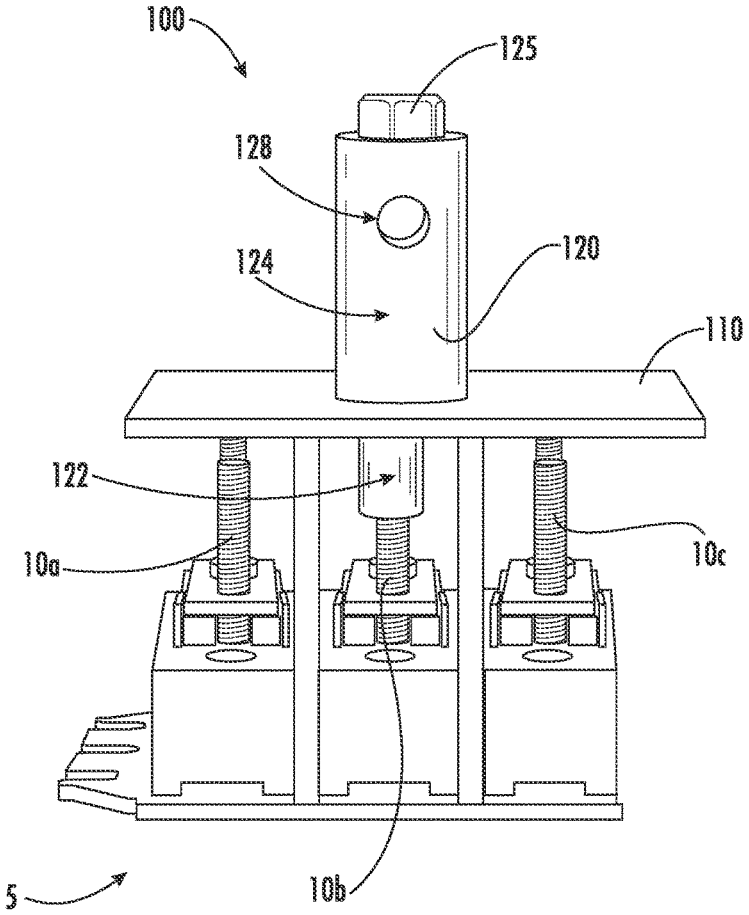
Figure 3B:
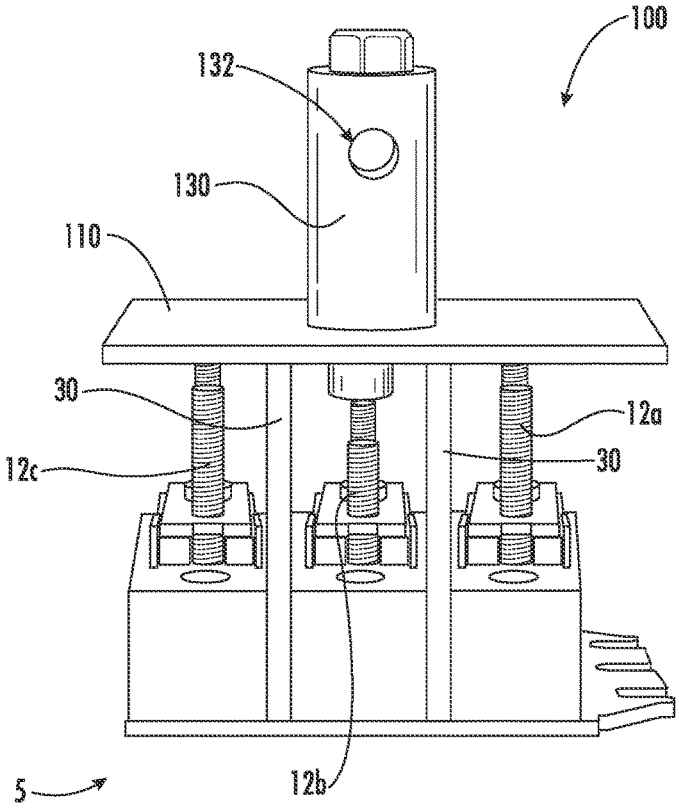
Figure 4:
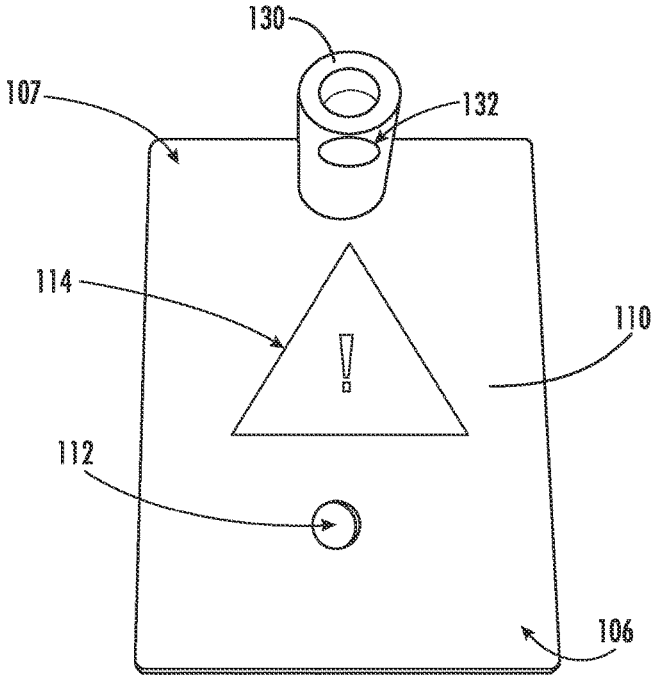
Figure 5:
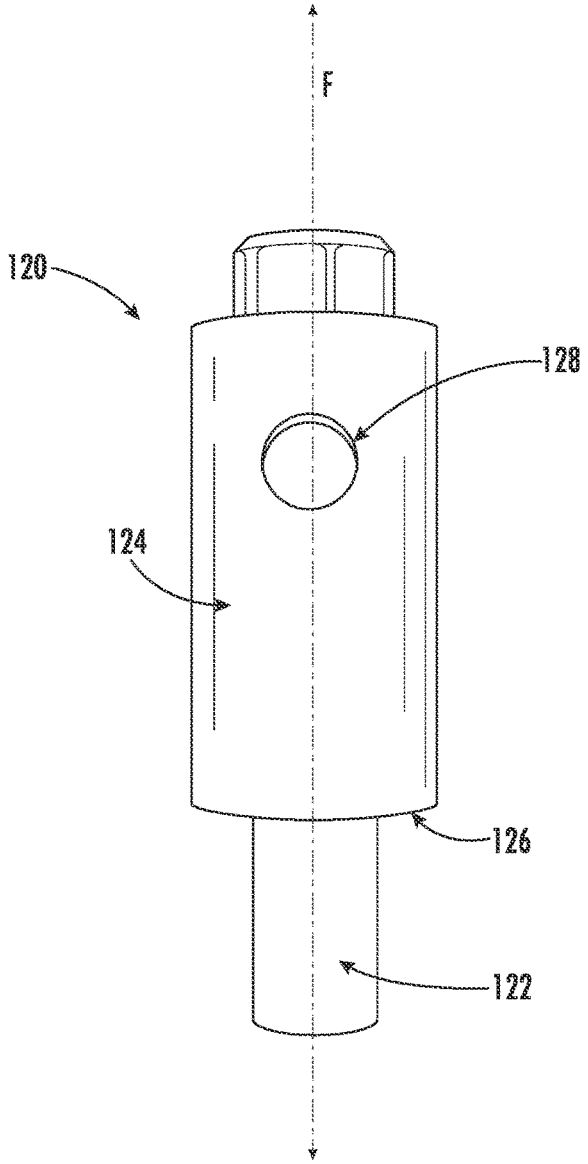
Figure 6:
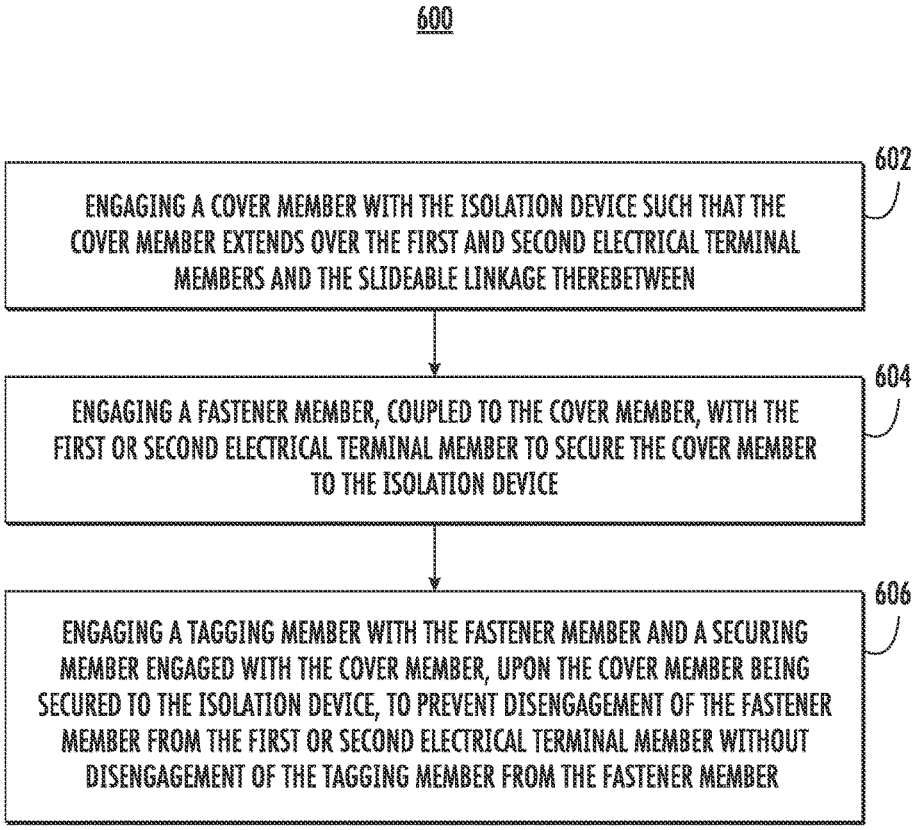

Having thus described the disclosure in general terms, reference will now be made to the accompanying drawings, which are not necessarily drawn to scale, and wherein:

FIG. 1 illustrates a perspective view of a lockout, tagout device engaged with a switchable energy isolation device according to one aspect of the present disclosure;

FIG. 2A illustrates a perspective view of a switchable energy isolation device according to one aspect of the present disclosure;

FIG. 2B illustrates a side view of a switchable energy isolation device according to one aspect of the present disclosure;

FIG. 3A illustrates a plan view of select components of a lockout, tagout device engaged with a switchable energy isolation device from one side of the switchable energy isolation device according to one aspect of the present disclosure;

FIG. 3B illustrates a plan view of select components of a lockout, tagout device engaged with a switchable energy isolation device of FIG. 3A from an opposing side of the switchable energy isolation device according to one aspect of the present disclosure;

FIG. 4 illustrates a perspective view of selected components of a lockout, tagout device according to one aspect of the present disclosure;

FIG. 5 illustrates a side view of a fastener member of a lockout, tagout device according to one aspect of the present disclosure; and FIG. 6 illustrates a block diagram of a method of engaging a lockout, tagout device with a switchable energy isolation device according to one aspect of the present disclosure.

DETAILED DESCRIPTION OF THE PREFERRED EMBODIMENTS

The present disclosure now will be described more fully hereinafter with reference to the accompanying drawings, in which some, but not all aspects of the disclosure are shown. Indeed, the disclosure may be embodied in many different forms and should not be construed as limited to the aspects set forth herein; rather, these aspects are provided so that this disclosure will satisfy applicable legal requirements. Like numbers refer to like elements throughout.

Referring to FIG. 1, a lockout, tagout device 100 is provided for a switchable energy isolation device 5. As shown in FIGS. 2A, 2B and 3, a switchable energy isolation device 5 may include a plurality of first electrical terminal members 10*a*, 10*b*, 10*c* and second electrical terminal members 12*a*, 12*b*, 12*c* that are configured to be in electrical communication with respective electrical circuits (not shown). Additionally, the energy isolation device 5 includes a plurality of slideable linkages 20*a*, 20*b*, 20*c* (or slidelinks) each disposed between and in electrical communication with respective pairs of the first and second electrical terminal members. The slidelink of each isolation device is movable for switching each of the respective electrical circuits and the corresponding isolation device between an isolated state (i.e., a non-energized state of the circuit) and a non-isolated state (i.e., an energized state of the circuit). For example, FIG. 2A illustrates a first slideable linkage 20*a* and a third slideable linkage 20*c* disposed with respect to the first and second electrical terminal members 10*a*, 10*c*, 20*a*, 20*c* such that the corresponding circuits and isolation devices are in the non-isolated state. More particularly, FIG. 2B illustrates a side view of a first slideable linkage 20*c* disposed with respect to the first and second electrical terminal members 10*c*, 12*c* such that the circuit and the isolation device is in the non-isolated state. Returning to FIG. 2A, a second slideable linkage 20*b* is shown to be disposed with respect to the first and second electrical terminal members 10*b*, 12*b* such that the electrical circuit and isolation device is in the isolated state. As such, the electrical circuit in electrical communication with the respective first and second electrical terminal members 10*b*, 12*b* of the isolation device is isolated and energized. Although the switchable energy isolation device 5 is illustrated as having three pairs of first and second electrical terminal members 10*a*, 10*b*, 10*c*, 12*a*, 12*b*, 12*c* and three slideable linkages 20*a*, 20*b*, 20*c* therebetween, one of ordinary skill in the art will appreciate that such an energy isolation device 5 may include any number of first and second electrical terminal members and respective slidable linkages.

According to one aspect, the lockout, tagout device 100 includes a cover member 110. Referring to FIGS. 1, 3A and 3B, the cover member 110 is configured to engage the switchable energy isolation device 5 so as to cover and/or extend over one or more pairs of the first and second electrical terminal members 10*a*, 10*b*, 10*c*, 12*a*, 12*b*, 12*c* and the corresponding slideable linkage(s) therebetween 20*a*, 20*b*, 20*c*. The cover member 110 may be configured to extend along a direction parallel to the longitudinal axis Y of the energy isolation device 5 when the cover member 110 is secured thereto. As shown in FIGS. 1, 3A and 4, the lockout, tagout device 100 includes a fastener member 120 coupled to the cover member 110. Referring to FIG. 3A, the fastener member 120 is configured to engage the first or second electrical terminal member 10, 12 so as to secure the cover member 110 to the energy isolation device 5. Referring to FIGS. 1, 3B and 4, the lockout, tagout device 100 also includes a securing member 130 engaged with the cover member 110. Additionally, the lockout, tagout device 100 includes a tagging member 140 configured to engage the fastener member 120 and the securing member 130, upon the cover member being secured to the switchable isolation device 5 (as shown in FIG. 1), to prevent disengagement of the fastener member 120 from the first or second electrical terminal member 10, 12 without disengagement of the tagging member 140 from the fastener member 120.

Referring to FIG. 5, the fastener member 120 may include a serially-arranged first portion 122 and second portion 124. The first portion 122 may be configured to extend through an aperture 112 (shown in FIG. 4) defined by the cover member 110. In particular, the first portion 122 may extend through the aperture 112 to engage the first or second electrical terminal member 10, 12. In some aspects, the first portion 122 may engage the first or second electrical terminal member 10, 12 in a threaded engagement. According to another aspect, the first portion 122 may be configured to engage the first or second electrical terminal member 10, 12 such that the fastener member 120 is securely coupled with the first or second electrical terminal member 10, 12 (e.g., a friction fit, snap fit, and/or the like).

Additionally, the first portion 122 may cooperate with the second portion 124 to secure the cover member 110 to the energy isolation device 5. For example, the diameter of the second portion 124 may be greater than a diameter of the aperture 112 such that when the first portion 122 extends through the aperture 112, the second portion 124 is prohibited from extending through the aperture 112. That is, a shoulder 126 defined by the transition between the first and second portions 122, 124 may substantially abut the cover member 110 when the first portion 122 fully extends through the aperture 112 such that the cover member 110 is secured to the energy isolation device 5, upon the fastener member 120 being engaged with the first or second electrical terminal member 10, 12. In one instance, for facilitating the securement of the cover member 110 to the energy isolation device 5, the length of the first portion 122 extending from the second portion 124 may be sufficient such that about 3 or 4 female threads within the internal channel defined by the first portion 122 engage the first or second electrical terminal member 10, 12. In this manner, for example, the cover member 110 may be securely fastened to the energy isolation device 5 even when there may be a number of wires or terminals attached to the first or second electrical terminal member 10, 12. In still further instances, for example, the fastener (hex) head 125 associated with the second portion 124, used for securing the fastener member 120 to the first or second electrical terminal member 120, may be the same size as the fastener (hex) head associated with the slideable linkages 20*a*, 20*b*, 20*c* (or slidelinks) (i.e., a 5/16" hex head).

Accordingly, one tool may be used to actuate/de-actuate the slidelink 20*a*, 20*b*, 20*c* as well as to install/uninstall the lockout, tagout device 100.

According to one aspect, the fastener member 120 and the securing member 130 may each define a respective tagging channel 128, 132 that extends transversely therethrough. According to some aspects, when the fastener member 120 is engaged with one of the first or second electrical terminal members 10, 12 so as to secure the cover member 110 with the energy isolation device 5, the respective tagging channels 128, 132 may be aligned (though are not necessarily required to be aligned) with one another, as shown in FIGS. 1, 3A and 3B. Additionally, the tagging channels 128, 132 may be configured to receive the tagging member 140 serially therethrough to secure the fastener member 120 and the securing member 130 to one another. For example, as shown in FIG. 1, the tagging member 140 may extend through the tagging channels 128, 132 of the fastener member 120 and the securing member 130 respectively, and may be configured to form a continuous loop upon engagement with the tagging channels 128, 132 to secure the fastener member 120 and the securing member 130 together. In some aspects, the tagging member 140 may include a zip-tie device configured to form a continuous loop upon engaging both the fastener member 120 and the securing member 130.

According to some aspects, when the tagging member 140 is engaged with the fastener member 120 and the securing member 130, the tagging member 140 is configured to prevent disengagement of the fastener member 120 from the first or second electrical terminal members 10, 12 without disengagement of the tagging member 140 from at least the fastener member 120 (i.e., the fastener member 120 cannot independently rotate to disengage the threaded engagement with the first or second electrical terminal member). For example, once the tagging member 140 engages each of the tagging channels 128, 132 and forms the continuous loop, the fastener member 120 is prevented from disengaging the first or second electrical terminal members 10, 12 until the continuous loop formed by the tagging member 140 is severed, broken, disconnected, and/or the like. That is, the continuous loop prevents the disengagement of the fastener member 120 from the first or second electrical terminal member 10, 12. In another aspect, the tagging member 140 may comprise any suitable securing element extending between the fastener member 120 and the securing member 130 that prevents the fastener member 120 from being removed from the first or second electrical terminal member 10, 12, without being first removed from engagement with the fastener member 120 (e.g., a bolt and nut combination, a toggle bolt, and/or the like). Accordingly, the tagging member 140 is configured to securely couple the fastener member 120 and the securing member 130 together until a user positively interacts with the tagging member 140 to disengage the tagging member 140 from the fastener member 120, in order to allow the fastener member 120, and thus the cover member 110 to be removed from the energy isolation device 5. Until removal of the cover member 110, access to the slidelink of the energy isolation device 5 is prevented.

According to some aspects, the tagging member 140 may further include a tag 142 (shown in FIG. 1) that provides a visual warning that the slideable linkage 20 of the switchable energy isolation device 5 is disposed in the isolated state, and that a circuit in electrical communication with the energy isolation device 5 has been de-energized, such that no attempt should be made to re-energize the circuit until interaction with the circuit (i.e. maintenance) has been completed. Referring to FIG. 4, the cover member 110 may otherwise include an indicia 114 providing the visual warning that the slideable linkage 20 of the switchable energy isolation device 5 is disposed in the isolated state. In some aspects, the indicia 114 may include any combination of visual and/or audible alerts that are configured to warn a user that a slideable linkage 20 disposed between first and second electrical terminal members 10, 12 is disposed in an isolated state.

According to another aspect, the securing member 130 may be configured to engage the other of the first or second electrical terminal members 10, 12 when the fastener member 120 is in engaged with one of the first or second electrical terminal members 10, 12. Additionally, the tagging member 140 engaged between the fastener member 120 and the securing member 130, may be configured to prevent disengagement of the securing member 130 from the other of the first or second electrical terminal members 10, 12 without disengagement of the tagging member 140 from the securing member 130. Alternatively, as shown in FIG. 3B, the securing member 130 may be configured to engage the cover member 110, but not engage the other first or second electrical terminal member 10, 12 of the energy isolation device 5. In such instances, the securing member 130 may otherwise be configured to prevent the cover member 110 from rotating with respect to the energy isolation device 5 by engaging a dividing element 30 thereof separating adjacent individual arrangements of the energy isolation device 5. In particular, the securing member may further include an anti-rotation element 134 that extends from the cover member 110 and is configured to engage the dividing element 30, if the cover member 110 is rotated with respect to the energy isolation device 5, so as to maintain the cover member 110 extending over or covering the first and second electrical terminal elements 10, 12, and the slidelink or slideable linkage 20 therebetween (i.e., such that the cover member 110 cannot be merely rotated to allow the slideable linkage 20 to be accessed, while the circuit is supposed to be locked out and tagged out.

According to some aspects, a method of engaging a lockout, tagout device with a switchable energy isolation device is also provided. As shown in FIG. 6, a method 600 for engaging a lockout, tagout device with a switchable energy isolation device, such as those described herein, is provided. The method 600 may include engaging a cover member with the energy isolation device such that the cover member extends over the first and second electrical terminal members and the slideable linkage therebetween (Block 602). For example, the method may include engaging the cover member with the energy isolation device so as to cover the first and second electrical terminal members and the slideable linkage therebetween, as shown in FIGS. 1, 3A, and 3B.

The method 600 may further include engaging a fastener member, coupled to the cover member, with the first or second electrical terminal member (Block 604) so as to secure the cover member to the isolation device. In some aspects, engaging a fastener member with the first or second electrical terminal member so as to secure the cover member to the isolation device may further include extending a first portion of the fastener member through an aperture defined by the cover member. For example, as shown in FIG. 5, a first portion 122 of the fastener member 120 may be configured to extend through the aperture 112, as shown in FIG.

4, which is defined by the cover member 110, to engage the first or second electrical terminal member in a threaded engagement.

Returning to FIG. 6, the method 600 may further include engaging a tagging member with the fastener member and a securing member engaged with the cover member, upon the cover member being secured to the isolation device, to prevent disengagement of the fastener member from the first or second electrical terminal member without disengagement of the tagging member from the fastener member (Block 606). For example, as shown in FIGS. 1, 3A, 3B and 5, the fastener member 120 may define a tagging channel 128, and the securing member 130 may define a tagging channel 132. The tagging channels 128, 132 of the respective fastener member 120 and securing member 130 are configured to receive the tagging member 140 serially therethrough such that the tagging member 140 secures the fastener member 120 and the securing member 130 together to prevent the disengagement of the fastener member 120 from the first or second electrical terminal member 10, 12 without disengaging the tagging member 140 from the fastener member 120. Additionally or alternatively, engaging the tagging member with the fastener member and the securing member may further include forming a continuous loop with the tagging member (as shown in FIG. 1), upon the tagging member engaging the fastener member and the securing member, such that the fastener member is prevented from disengaging the first or second electrical terminal member without severing, breaking, disconnecting, and/or the like the continuous loop formed by the tagging member.

Additionally or alternatively, the method may further include engaging the securing member with the other of the first or second electrical terminal member so as to secure the cover member to the energy isolation device (i.e., each of the fastener member and the securing member is engaged with one of the first and second electrical terminal elements). As with the fastener member, the tagging member may be configured to prevent disengagement of the securing member from the other of the first or second electrical terminal member without disengagement of the tagging member from the securing member.

Many modifications and other aspects of the disclosures set forth herein will come to mind to one skilled in the art to which these disclosures pertain having the benefit of the teachings presented in the foregoing descriptions and the associated drawings. For example, those of skill in the art will appreciate that embodiments not expressly illustrated herein may be practiced within the scope of the present disclosure, including that features described herein for different embodiments may be combined with each other and/or with currently-known or future-developed technologies while remaining within the scope of the claims presented here. Therefore, it is to be understood that the disclosures are not to be limited to the specific aspects disclosed and that equivalents, modifications, and other aspects are intended to be included within the scope of the appended claims. Although specific terms are employed herein, they are used in a generic and descriptive sense only and not for purposes of limitation.

That which is claimed:

1. A lockout, tagout device for a switchable energy isolation device, the switchable energy isolation device including a first and second electrical terminal members and a slideable linkage being disposed and in electrical communication therebetween and configured to switch the first and second electrical terminal members between an isolated and a non-isolated state, the device comprising:

a cover member configured to engage the isolation device so as to extend over the first and second electrical terminal members and the slideable linkage therebetween;

a fastener member coupled to the cover member and configured to engage the first or second electrical terminal member so as to secure the cover member to the isolation device;

a securing member engaged with the cover member; and a tagging member configured to engage the fastener member and the securing member, upon the cover member being secured to the isolation device, to prevent disengagement of the fastener member from the first or second electrical terminal member without disengagement of the tagging member from the fastener member; wherein the fastener member further includes serially-arranged first and second portions, the first portion configured to extend through an aperture defined by the cover member to engage the first or second electrical terminal member and cooperative with the second portion to secure the cover member to the isolation device.

2. The device of claim 1, wherein the first portion of the fastener member has a diameter smaller than a diameter of the second portion of the fastener member, the second portion diameter being larger than a diameter of the aperture.

3. The device of claim 1, wherein the first portion of the fastener member is configured engage the first or second electrical terminal member in a threaded engagement.

4. The device of claim 1, wherein the fastener member and the securing member each define a tagging channel extending respectively therethrough, the tagging channels configured to receive the tagging member serially therethrough to secure the fastener member and the securing member together.

5. The device of claim 4, wherein the tagging member is configured to form a continuous loop upon engagement with the tagging channels of the fastener member and the securing member.

6. The device of claim 5, wherein the tagging member is configured to prevent the fastener member from disengaging the first or second electrical terminal member until the continuous loop of the tagging member is disengaged from the fastener member.

7. The device of claim 1, wherein the cover member includes an indicia providing a visual warning that the slideable linkage of the switchable energy isolation device is disposed in the isolated state and a circuit in electrical communication with the isolation device has been de-energized.

8. The device of claim 1, wherein the securing member is configured to engage the other of the first or second electrical terminal member so as to secure the cover member to the isolation device.

9. The device of claim 8, wherein the tagging member configured to engage the fastener member and the securing member, and is configured to prevent disengagement of the securing member from the other of the first or second electrical terminal member without disengagement of the tagging member from the securing member.

10. A method of engaging a lockout, tagout device with a switchable energy isolation device, the switchable energy isolation device including a first and second electrical terminal members and a slideable linkage disposed and in electrical communication therebetween for switching the isolation device between an isolated and a non-isolated state, the method comprising:

engaging a cover member with the isolation device such that the cover member extends over the first and second electrical terminal members and the slideable linkage therebetween;

engaging a fastener member, coupled to the cover member, with the first or second electrical terminal member to secure the cover member to the isolation device;

engaging a tagging member with the fastener member and a securing member engaged with the cover member, upon the cover member being secured to the isolation device, to prevent disengagement of the fastener member from the first or second electrical terminal member without disengagement of the tagging member from the fastener member; wherein engaging the fastener member with the first or second electrical terminal member includes extending a first portion of the fastener member through an aperture defined by the cover member, the first portion of the fastener member having a diameter smaller than a diameter of a second portion of the fastener member serially extending therefrom, with the second portion diameter being larger than a diameter of the aperture.

11. The method of claim 10, wherein engaging the fastener member with the first or second electrical terminal member includes engaging the fastener member with the first or second electrical terminal member in a threaded engagement.

12. The method of claim 10, wherein engaging the tagging member with the fastener member and the securing member includes extending the tagging member serially through a tagging channel defined by each of the fastener member and the securing member, upon the cover member being secured to the isolation device.

13. The method of claim 12, wherein engaging the tagging member with the fastener member and the securing member includes forming a continuous loop with the tagging member, upon the tagging member engaging the fastener member and the securing member, such that the fastener member is prevented from disengaging the first or second electrical terminal member without the continuous loop formed by the tagging member being disengaged from the fastener member.

14. The method of claim 10 further comprising engaging the securing member with the other of the first or second electrical terminal member so as to secure the cover member to the isolation device, the tagging member being configured to prevent disengagement of the securing member from the other of the first or second electrical terminal member without disengagement of the tagging member from the securing member.

* * * * *